US010035035B2

(12) United States Patent
Crevits

(10) Patent No.: US 10,035,035 B2
(45) Date of Patent: Jul. 31, 2018

(54) SELF-SUPPORTING MUSCULAR TRAINING APPARATUS CONVERTIBLE BETWEEN A STORAGE POSITION AND A WORKING POSITION

(71) Applicant: Philippe Crevits, La Chapelle Saint Mesmin (FR)

(72) Inventor: Philippe Crevits, La Chapelle Saint Mesmin (FR)

( * ) Notice: Subject to any disclaimer, the term of this patent is extended or adjusted under 35 U.S.C. 154(b) by 0 days.

(21) Appl. No.: 15/534,759

(22) PCT Filed: Nov. 19, 2015

(86) PCT No.: PCT/FR2015/053141
§ 371 (c)(1),
(2) Date: Jun. 9, 2017

(87) PCT Pub. No.: WO2016/092171
PCT Pub. Date: Jun. 16, 2016

(65) Prior Publication Data

US 2017/0340912 A1 Nov. 30, 2017

(30) Foreign Application Priority Data

Dec. 12, 2014 (FR) ..... 14 62356

(51) Int. Cl.
*F16M 11/00* (2006.01)
*A63B 21/00* (2006.01)
(Continued)

(52) U.S. Cl.
CPC ..... *A63B 21/00047* (2013.01); *A63B 1/00* (2013.01); *A63B 21/068* (2013.01);
(Continued)

(58) Field of Classification Search
USPC ..... 248/176.1
See application file for complete search history.

(56) References Cited

U.S. PATENT DOCUMENTS 277,399 A * 5/1883 Worthington ..... A63B 3/00 482/41
4,844,448 A * 7/1989 Niznik ..... A63B 21/04 482/129

(Continued)

FOREIGN PATENT DOCUMENTS

CN 202161737 U 3/2012

OTHER PUBLICATIONS

English translation of the Written Opinion of the International Searching Authority dated Feb. 19, 2016 for corresponding International Application No. PCT/FR2015/053141, filed Nov. 19, 2015.

(Continued)

*Primary Examiner* — Monica E Millner
(74) *Attorney, Agent, or Firm* — David D. Brush; Westman, Champlin & Koehler, P.A.

(57) ABSTRACT

A muscular training apparatus to present muscular training accessories. The muscular training apparatus has a bottom part including a central panel and two lateral panels on each side of the central panel. The two lateral panels are installed free to pivot about the central panel. The apparatus can be converted between at least one working position and one storage position. In a working position, the lateral panels are unfolded at the sides of the central panel to form a self-supporting structure. In the storage position, the lateral panels are folded adjacent to the central panel. The bottom part further includes a locking element to secure the self-supporting structure in the working position of the apparatus.

9 Claims, 3 Drawing Sheets

(51) Int. Cl.

| | |
|---|---|
| ***A63B 1/00*** | (2006.01) |
| ***A63B 21/068*** | (2006.01) |
| ***A63B 23/035*** | (2006.01) |
| ***A63B 23/12*** | (2006.01) |

(52) U.S. Cl.
CPC ..... *A63B 23/0355* (2013.01); *A63B 23/1218* (2013.01); *A63B 23/1227* (2013.01); *A63B 2208/029* (2013.01); *A63B 2210/50* (2013.01); *A63B 2225/09* (2013.01); *A63B 2225/093* (2013.01)

(56) References Cited

U.S. PATENT DOCUMENTS

| | | | | |
|---|---|---|---|---|
| 5,046,722 | A * | 9/1991 | Antoon | A63B 17/00 482/39 |
| 5,961,430 | A | 10/1999 | Zuckerman et al. | |
| 6,328,679 | B1 * | 12/2001 | Croft | A63B 21/023 482/121 |
| 7,488,277 | B1 | 2/2009 | Knapp | |
| 7,850,576 | B2 * | 12/2010 | Sellke | A63B 63/004 273/407 |
| 7,878,954 | B2 * | 2/2011 | McBride | A63B 21/023 482/121 |
| 2004/0124680 | A1 | 7/2004 | Harris | |
| 2008/0161162 | A1 | 7/2008 | Dokshutsky | |
| 2011/0183827 | A1 * | 7/2011 | Radi | A63B 21/00047 482/140 |
| 2011/0190103 | A1 | 8/2011 | Nguyen | |
| 2013/0324383 | A1 | 12/2013 | Rogers | |

OTHER PUBLICATIONS

International Search Report dated Feb. 12, 2016 for corresponding International Application No. PCT/FR2015/053141, filed Nov. 19, 2015.

Written Opinion of the International Searching Authority dated Feb. 12, 2016 for corresponding International Application No. PCT/FR2015/053141, filed Nov. 19, 2015.

* cited by examiner 21
6
7
200
21
6
200
2
20
200
4
40
1
301
51
5
52
51
40
300
52
5
3
300
6
30
6
7
31
301
52
52
301
4
7
40
40
31

SELF-SUPPORTING MUSCULAR TRAINING APPARATUS CONVERTIBLE BETWEEN A STORAGE POSITION AND A WORKING POSITION

CROSS-REFERENCE TO RELATED APPLICATIONS

This Application is a Section 371 National Stage Application of International Application No. PCT/FR2015/053141, filed Nov. 19, 2015, the content of which is incorporated herein by reference in its entirety, and published as WO 2016/092171 on Jun. 16, 2016, not in English.

FIELD OF THE DISCLOSURE

The domain of the invention is the design and fabrication of equipment for practising sport. More precisely, the invention relates to the design of muscular training apparatus, and more particularly a body building apparatus.

BACKGROUND OF THE DISCLOSURE

Physical training is intended to improve a person's physical performances. Traditionally, muscular training apparatuses have been developed so that a person can carry out specific exercises for his or her muscular training. These exercises can be of the "isolation exercise" type that isolates muscle groups, or "multi-joint exercise" type that makes an entire muscle chain work at the same time or in sequence. One example of a multi-joint exercise is pull-ups, that develop back and arm muscles.

Thus, for the practice of muscular training and in order to perform a global and harmonious workout for all muscle groups, it is essential to use a variety of training methods and to perform different exercises.

Prior art knows several types of apparatus for such training, that can be used for one or several exercises. These apparatuses have the disadvantage that they occupy a large volume due to the large number of apparatus types dedicated to exercises.

Complete and multi-purpose apparatuses have been designed to satisfy this problem, combining most muscular training exercises possible with the most frequently used muscular training apparatuses into a single apparatus.

Nevertheless, this type of apparatus requires a large amount of space assigned to its use. Even if elements can be mounted on it remaining free to move so that they can be folded away or stored, this type of apparatus usually has the disadvantage that it monopolises the space in which it is installed after it has been used.

Muscular training apparatuses that offer a wide range of exercises can be sold in stores in disassembled form and stored in transport boxes. Due to the heavy weight of these apparatuses, some of them may be packed in many transport boxes, however each of them remains relatively heavy and difficult to transport. Furthermore, in particular these apparatuses have screwed tubular structures that are not designed to be disassembled once they have been assembled and it is not easy to move them because they are heavy.

Muscular training apparatuses for the general public and intended for use at home are also known. They are sometimes designed so that they can be folded to facilitate storage. However, no or few apparatuses of this type combine a range of exercises and remain compact.

Furthermore, the development of personal coaching at home leads to a need for this type of equipment capable of offering a variety of exercises while remaining compact and transportable, and that can quickly and easily be put into place and stored.

Several exercise benches have been proposed in prior art, and particularly in patent documents published under numbers US2013/324383, US2008/161162, U.S. Pat. No. 5,961,430, U.S. Pat. No. 7,488,277, US2011/190103, US2004/124680 and CN-202 161 737. However, these solutions do not satisfy the expectations described above.

SUMMARY

An aspect of the present disclosure relates to a muscular training apparatus designed to present muscular training accessories, the muscular training apparatus having a bottom part comprising a central panel and two lateral panels on each side of the central panel, the two lateral panels being installed free to pivot about the central panel, characterised in that:

- the apparatus can be converted between at least one working position and one storage position;
- in a working position, the lateral panels are unfolded at the sides of the central panel to form a self-supporting structure;
- in the storage position, the lateral panels are folded adjacent to the central panel;
- the bottom part comprises an element locking the position of the lateral panels relative to the central panel in the working position of the apparatus to secure the self-supporting structure.

According to one particular embodiment, the muscular training apparatus according to the invention is of the body building type.

The muscular training apparatus according to the invention can thus reconcile a large variety of exercises (for example of the pull-up type, or dips, etc., that is compact and easily transportable when the apparatus in the storage position.

As will be explained in more detail later, the muscular training apparatus can be put in at least two positions so that it can be adapted for used in a home, and particularly in a home in which no space can be dedicated to muscular training.

Such an apparatus according to the invention has particularly advantageous characteristics for the practice of muscular training in collective rooms. This apparatus can for example be used for collective courses when performing different exercises and can then be quickly put back into its storage position by participants of the course to release the exercise room.

The "central panel" means a solid or perforated element positioned near the middle in the bottom part. For example and non-exclusively, as illustrated by the preferred embodiment described below, the central panel is composed of a metal frame. The central panel may also comprise one or several panels assembled to each other, without going outside the framework of the invention.

"Lateral panels" are composed particularly, for example and by analogy with the central panel, of a metal frame, a chassis or one or several panels assembled together.

Furthermore, a muscular training apparatus according to the invention can be provided with many different muscular training accessories located at different heights. These muscular training accessories can be stable support points (bars, handles, elbow rests, etc.) or they may be unstable gripping elements (rope, elastic, etc.). For example, the locking element can form a muscular training accessory by providing several bearing supports.

Thus, a wide variety of exercises can be performed with the apparatus in the working position. Furthermore, when the apparatus is in its storage position, all its elements are folded on each other and thus it becomes particularly compact and is easily transportable.

The locking element prevents any changes in the position of the lateral panels relative to the central panel when a user of the apparatus is performing a muscular training exercise.

This locking element also secures the bottom part in its self-supporting position.

Preferably, the muscular training apparatus has an upper part, and:

- in a working position, the upper part is above the bottom part;
- in the storage position, the upper part and the bottom part of the apparatus are brought facing each other and are retained in this position.

The expressions "brought facing each other and retained in this position" means that the bottom part and the upper part are facing each other and immediately adjacent to each other, or that one of the parts is placed in contact with the other part and that the parts are retained in this position, or that one of the parts is inserted and retained in position inside the other part.

This upper part makes it possible to increase the number of exercises that can be done on the muscular training apparatus according to the invention, without increasing the overall size of the muscular training apparatus in its stored position, or only slightly it slightly.

According to one advantageous solution, the locking element comprises two arms free to move relative to the central panel depending on the position of the apparatus, the arms:

- being parallel and contiguous or almost contiguous with the central panel in the storage position of the apparatus;
- extending at a distance from the central panel towards the lateral panels in a working position of the apparatus.

According to one preferred embodiment, the locking element is in the form of a U free to move relative to the central panel about a pivot link.

The locking element made in this way can secure the position of the lateral panels relative to the central panel while being adapted to the apparatus so as to occupy as little space as possible when the apparatus is in its stored position. Another advantage of such a locking element is that its weight is low, so that the apparatus can be more easily transported.

The arms of the U can be divergent from each other. In this way, the distance between the arms is variable along their length so that a user can find the position best suited to his or her morphology in which he or she can perform an exercise when said locking element is used as a muscular training accessory.

According to one advantageous characteristic, the upper part comprises a central panel and two lateral panels installed free to pivot relative to the central panel, the lateral panels of the upper part being unfolded at the side of the central panel of the upper part to form a self-supporting structure when the apparatus is in its working position.

By being self-supporting by itself, the upper part with this design has the advantage that it makes it possible for the muscular training apparatus to take up other working positions so as to increase the variety of muscular training exercises that can be done using the invention.

For example, for a particular exercise, the upper part can be dissociated from the bottom part to form high support points for the top of the body and also for the bottom of the body.

Advantageously, in a working position, the lateral panels of the upper part and the bottom part have assembly means so that they can be fixed to each other to form a single self-supporting structure.

The single self-supporting structure can be used to perform exercises that for example require high support points with reinforced stability. The muscular training apparatus according to the invention made in thus way has improved stability.

According to one advantageous embodiment, the locking element is located close to the top end of the central panel of the bottom part and it forms assembly means for the lateral panels of the top part and the bottom part of the apparatus in its working position.

By combining the locking element and the assembly means, the total weight of the structure and its dimensions are reduced so that it is more transportable when in its storage position.

Preferably, the lateral panels are provided with a plurality of pairs of holes in corresponding positions on each lateral panel to hold a pull-up bar in an approximately horizontal position.

The invention in this form can increase the possible number of muscular training exercises.

According to one advantageous characteristic, the central panel of the bottom part and/or the central panel of the upper part and/or the locking element are tubular structures.

According to this characteristic and as described above, the muscular training apparatus in its storage position is more easily transportable, particularly due to the significant reduction in the weight of the apparatus and to the reduction in its size.

According to one preferred characteristic, the lateral panels of the bottom part and/or the upper part comprise recesses through which a user can pass his or her arms when they want to perform exercises that require a wide grip.

Furthermore, in combination with the position of muscular training accessories (bars, holes, etc.), these recesses can optimise the distribution of stresses applied to the structure of the muscular training structure when a user is performing exercises. One particular result of this optimisation of stresses is a limitation of forces applied on the central panels, which in particular reduces the weight of the structure of the muscular training apparatus and makes it easier to transport it in its storage position.

According to another advantageous characteristic, the muscular training apparatus comprises a mat that is brought into position and retained facing the bottom part or the top part of the apparatus in the storage position, the mat being placed in front of the central panel and between the lateral panels of the bottom part of the apparatus in the working position.

The integration of such a mat into a convertible muscular training apparatus provides an attractive global system for a user who in particular will not need to purchase and store another exercise mat.

Furthermore, such a mat can help to contain elements of the muscular training apparatus in their position when said apparatus is in its storage position. In particular, the mat can help to retain the pull-up bars contained inside the apparatus.

Finally, the mat can improve the global appearance of the muscular training apparatus in the storage position by concealing the different stored elements forming part of the apparatus, at least on one face.

BRIEF DESCRIPTION OF THE DRAWINGS

Other characteristics and advantages of the invention will become clearer after reading the following description of one preferred embodiment of the invention given as an illustrative and non-limitative example, and the appended drawings among which.

DETAILED DESCRIPTION OF ILLUSTRATIVE EMBODIMENTS

Figures 1, 2:
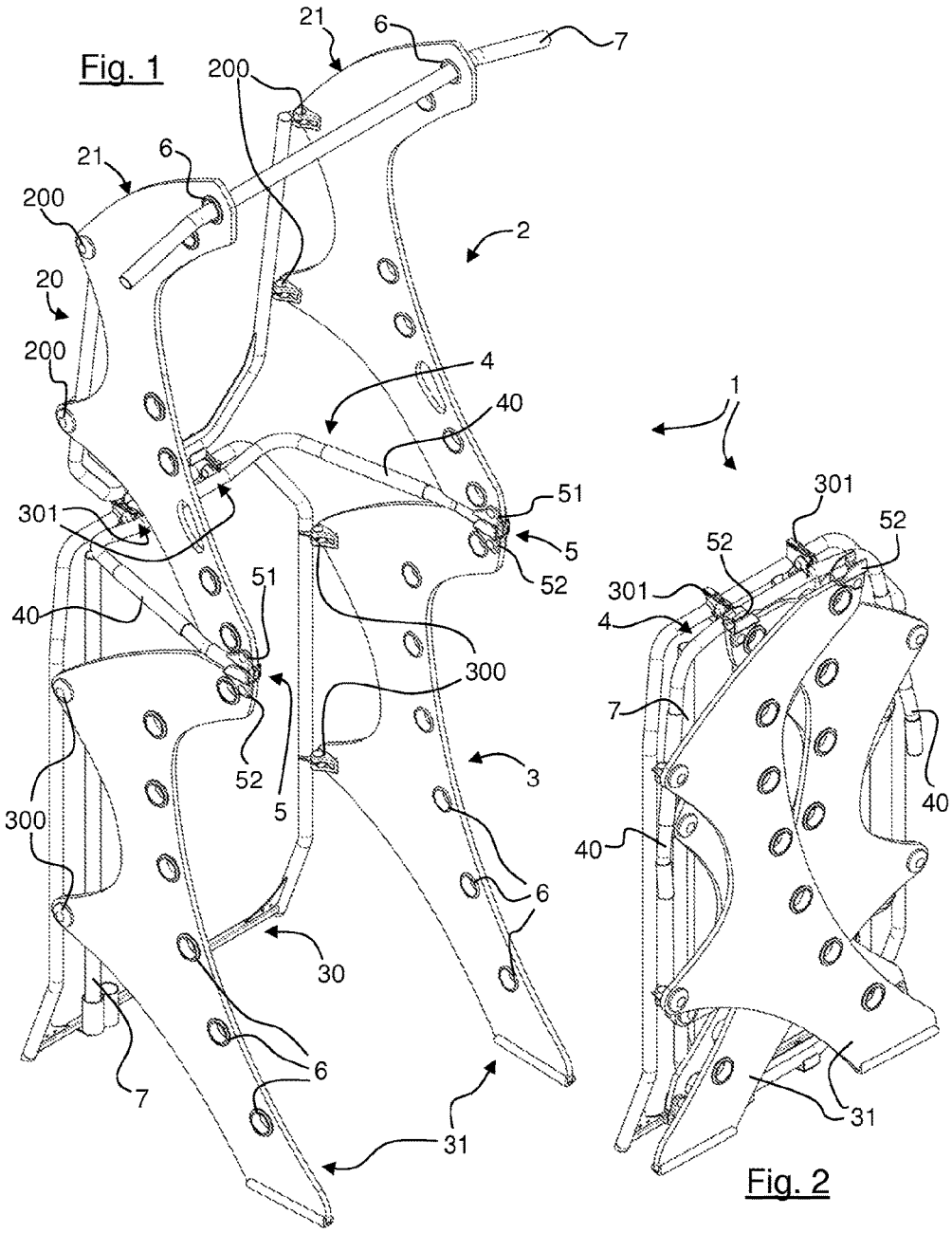
FIGS. 1 and 2 are diagrammatic views of the muscular training apparatus according to the invention, in a working position and the storage position respectively.

As shown on FIGS. 1 and 2, the muscular training apparatus 1 according to the invention is convertible between a working position (FIG. 1) and a storage position (FIG. 2).

With reference to FIGS. 1, 3, 4, 5 et 6, the muscular training apparatus 1 has a bottom part 3.

As shown on FIGS. 1, 3, 4, 5 et 6, the bottom part comprises a central panel 30 and two lateral panels 31, one on each side of the central panel. The two lateral panels of the bottom part are installed free to pivot about the central panel such that they can move from an unfolded position at the side of the central panel (FIGS. 1, 3, 4, 5 and 6) to a folded position facing the central panel (FIG. 2). The connection between the central panel and the lateral panel is made using bottom hinges 300.

Thus, the apparatus can be converted between a working position of the apparatus in which the lateral panels are unfolded at the side of the central panel and form a self-supporting structure, and a storage position in which the lateral panels are folded facing the central panel.

Figure 3:
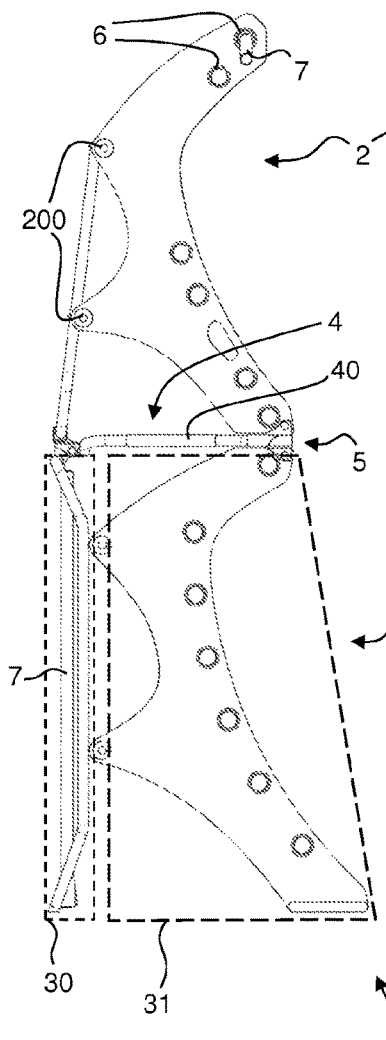
FIGS. 3 and 4 are diagrammatic lateral and front views respectively of the muscular training apparatus according to the invention, in a working position.
Figure 4:
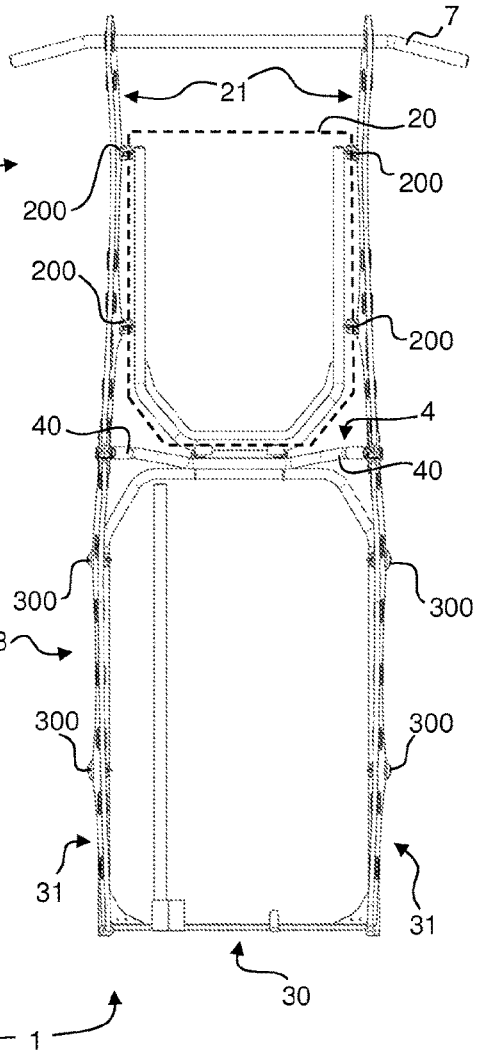

With reference to FIGS. 1, 3, and 4, the muscular training apparatus 1 also has an upper part 2. In this embodiment, in the storage position of the apparatus, the upper part and the bottom part are brought facing each other and are retained in this position.

For example and as illustrated in FIG. 2, in the storage position the upper part and the bottom part are positioned to be parallel to and adjacent to each other (face to face) so as to minimise the size of the apparatus.

As shown on FIGS. 1, 3, 4, 5 and 6, the bottom part comprises a locking element 4 that locks the position of the lateral panels relative to the position of the central panel in the working position of the apparatus. This locking element 4 thus secures the self-supporting structure in a working position.

According to the preferred embodiment illustrated by the drawings, the locking element 4 comprises two arms 40 free to move relative to the central panel depending on the position of the apparatus.

The arms are essentially parallel to and contiguous with the central panel of the bottom part in the storage position of the apparatus (FIG. 2). In the working position of the apparatus, the arms 40 extend away from the central panel towards the lateral panels (FIGS. 1, 3, 5 and 6). These arms can form muscular training accessories of the parallel bars type. Advantageously, these arms are slightly divergent providing the user with a variable separation distance from one end of the arm to the other, as described above.

In particular, the locking element 4 illustrated on FIGS. 1 and 2 is U-shaped and is free to move relative to the central panel about a pivot link, particularly using intermediate hinges 301.

Figure 5:
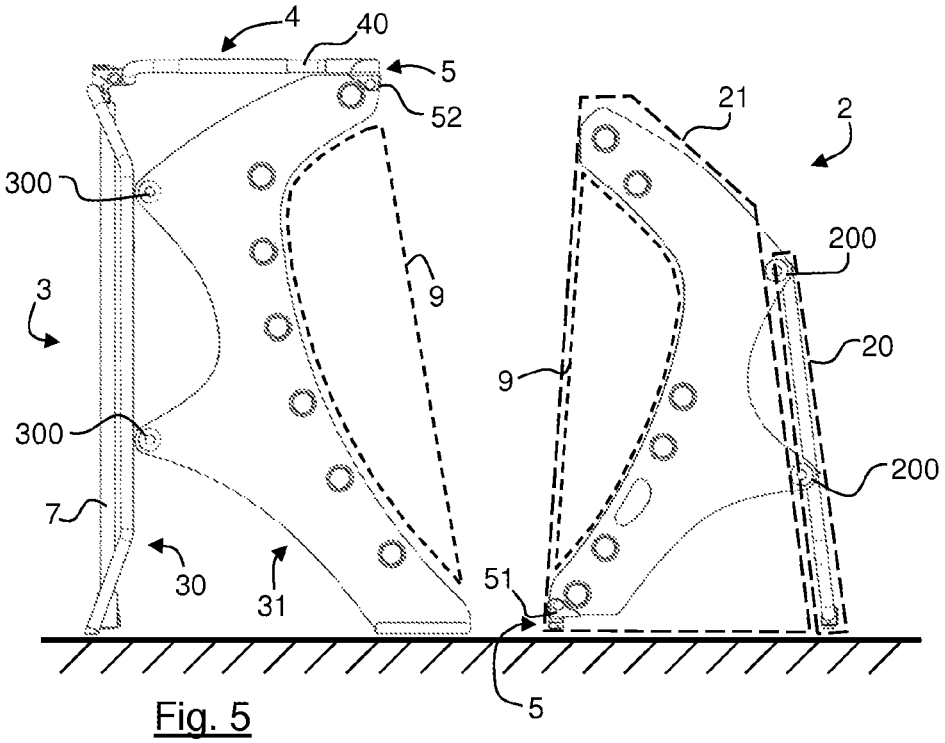
FIG. 5 is a diagrammatic view of one possible working position of the muscular training apparatus according to the invention.

As shown on FIGS. 1, 3, 4 and 5, the upper part 2 comprises a central panel 20 and two lateral panels 21 installed free to pivot relative to the central panel, particularly using upper hinges 200. In a working position, the lateral panels of the upper part 2 are unfolded at the sides of the central panel of the upper part to form a self-supporting structure (FIG. 5).

According to this embodiment, the lateral panels of the upper part and the bottom part have assembly means 5 so that they can be fixed to each other and thus form a single self-supporting structure.

As shown on the figures, the locking element 4 is located close to the upper end of the central panel of the bottom part. The locking element 4 forms the means of assembly of the lateral panels of the upper part and the bottom part of the apparatus in the working position. The locking element thus comprises a section on each arm that can be rigidly fixed with:

- a lower fastening system 52 located at the upper end of the lateral panels 31 of the bottom part;
- an upper fastening system 51 located at the bottom end of the lateral panels 21 of the upper part;

For example, the fastening systems consist of clip and/or hook type systems that can be fixed onto a tubular section of the locking element and at the same time make a connection by mutual engagement between the lower attachment system and the upper attachment system Preferably, the lateral panels of the bottom part and of the top part are provided with a plurality of pairs of holes 6 in corresponding positions on each panel to hold a pull-up bar 7 in an approximately horizontal position.

According to the preferred embodiment of the invention shown on the figures, the central panel of the bottom part, the central panel of the upper part and the locking element are tubular structures.

FIG. 5 shows a working position of the muscular training apparatus. The bottom part and the upper part are facing each other so that muscular training exercises can be carried out by offering different possible usage combinations of the muscular training accessories.

As can be clearly seen on FIG. 5, recesses 9 are formed in the lateral panels 31, 21. This shape of the lateral panels allows a user to get into position between the lateral panels and to pass his or her arms through the recesses to get a grip on the outside of the lateral panels.

Figure 6:
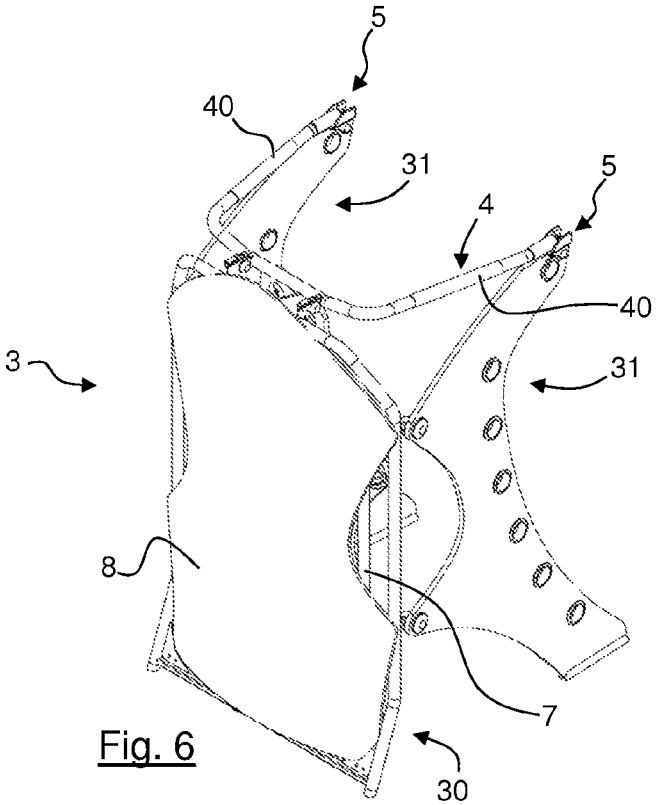
FIG. 6 is a diagrammatic view of the bottom part of the muscular training apparatus according to the invention, with the mat brought into contact with and retained in position facing the bottom part.

As illustrated in FIG. 6, the muscular training apparatus comprises a mat 8. This mat is brought into contact with and is retained in contact with the bottom part and/or the upper part of the apparatus in the storage position.

In the working position of the muscular training apparatus, the mat will be positioned in front of the central panel and between the lateral panels of the bottom part 3.

The user can proceed as follows to convert the muscular training apparatus from a working position to its storage position.

Firstly, the mobile muscular training accessories are separated (particularly the pull-up bar(s)) and for example can be put away or attached onto the central panel 31 of the bottom part. The lateral panels 21 of the upper part are then separated from the lateral panels 31 of the bottom part (separation of the lateral panels 21 from the assembly means 5 formed by the locking element 4), and said lateral panels 21 of the upper part are then folded towards the central panel 20 of the upper part. In other words, the lateral panels 21 are folded on each other and on the central panel 20, in an essentially parallel arrangement.

The upper part thus folded is then brought into position facing the bottom part 3. More precisely, the upper part is then positioned inside the unfolded bottom part such that the upper part is essentially parallel to the central panel of the bottom part. Once the upper part 2 is in position, the locking element 4 is detached from the lateral panels 31 of the bottom part and folded down to face the bottom part (either inside the bottom part such that the arms 40 are essentially close to and parallel to the central panel 30 of the bottom part, and the lateral panels 31 of the bottom part are then folded in front of the central panel on the upper part that is thus retained in position facing the bottom part. In other words, the upper part is held in position essentially parallel to the bottom part and/or remains contained inside the bottom part as illustrated in FIG. 2.

Finally, the mat 8 is brought into contact with and is retained in contact with the bottom part and/or the upper part of the apparatus in the storage position, as illustrated in FIG. 6.

Thus, it will be understood that the muscular training apparatus is compact and can easily be transported when it is in its storage position.

One particular embodiment overcomes the disadvantages of prior art.

An embodiment discloses a muscular training apparatus capable of offering a wide variety of exercises.

An embodiment discloses such an apparatus that is compact and easily transportable.

An embodiment discloses such an apparatus in which placement and storage operations can be done easily.

Although the present disclosure has been described with reference to one or more examples, workers skilled in the art will recognize that changes may be made in form and detail without departing from the scope of the disclosure and/or the appended claims.

The invention claimed is:

1. A muscular training apparatus designed to present muscular training accessories, the muscular training apparatus comprising:

a bottom part comprising a central panel and two lateral panels on each side of the central panel, the two lateral panels being installed free to pivot about the central panel;

wherein the apparatus is convertible between at least one working position and one storage position:

in a working position, the lateral panels are unfolded at the sides of the central panel to form a self-supporting structure;

in the storage position, the lateral panels are folded adjacent to the central panel; and wherein the bottom part comprises an element locking the position of the lateral panels relative to the central panel in the working position of the apparatus to secure the self-supporting structure; and an upper part, wherein in the working position, the upper part is above the bottom part, and in the storage position, the upper part and the bottom part of the apparatus are brought facing each other and are retained in this position.

2. The muscular training apparatus according to claim 1, wherein:

the upper part comprises a central panel and two lateral panels installed free to pivot relative to the central panel, in the working position of the apparatus, the lateral panels of the upper part are unfolded at the sides of the central panel of the upper part to form a self-supporting structure.

3. The muscular training apparatus according to claim 2, wherein in the working position, the lateral panels of the upper part and the bottom part have an assembly so that they can be fixed to each other to form a single self-supporting structure.

4. The muscular training apparatus according to claim 3, wherein the locking element is located close to a top end of the central panel of the bottom part and the locking element forms the assembly for the lateral panels of the top part and the bottom part of the apparatus in the working position.

5. The muscular training apparatus according to claim 1, wherein at least one of the central panel of the bottom part, the central panel of the upper part, or the locking element are tubular structures.

6. The muscular training apparatus according to claim 1, wherein the apparatus comprises a mat that is brought into position and retained facing the bottom part or the top part of the apparatus in the storage position, the mat being placed in front of the central panel and between the lateral panels of the bottom part of the apparatus in the working position.

7. The muscular training apparatus according to claim 1, wherein the locking element comprises two arms free to move relative to the central panel depending on the position of the apparatus, the arms:

being parallel and contiguous with the central panel in the storage position of the apparatus; and extending at a distance from the central panel towards the lateral panels in a working position of the apparatus.

8. The muscular training apparatus according to claim 7, wherein locking element is in the form of a U free to move relative to the central panel about a pivot link.

9. The muscular training apparatus according to claim 1, wherein the lateral panels comprise a plurality of pairs of holes in corresponding positions on each panel to hold a pull-up bar in an approximately horizontal position.

* * * * *